US007347708B1

(12) United States Patent
Huang

(10) Patent No.: US 7,347,708 B1
(45) Date of Patent: Mar. 25, 2008

(54) FIRM-STRUCTURED PLUG

(76) Inventor: Tzi-Chen Huang, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/505,193

(22) Filed: Aug. 17, 2006

(51) Int. Cl.
*H01R 13/625* (2006.01)

(52) U.S. Cl. ..... 439/346; 439/263

(58) Field of Classification Search ..... 439/106, 439/102, 346, 263, 744, 411, 347; 200/341, 200/345

See application file for complete search history.

(56) References Cited

U.S. PATENT DOCUMENTS 3,710,304 A * 1/1973 Warner et al. ..... 439/346
4,136,919 A * 1/1979 Howard et al. ..... 439/346
5,352,132 A * 10/1994 O'Keefe et al. ..... 439/346
5,413,498 A * 5/1995 Ursich ..... 439/346
5,893,772 A * 4/1999 Carmo et al. ..... 439/346
6,193,539 B1 * 2/2001 Chang ..... 439/346
7,172,451 B1 * 2/2007 Ratzlaff ..... 439/346
2004/0140190 A1 * 7/2004 Searle et al. ..... 200/341

* cited by examiner

*Primary Examiner*—Renee Luebke
*Assistant Examiner*—Harshad C Patel

(57) ABSTRACT

A plug comprises an insulating casing; an insulating seat installed in the insulating casing; a sliding member or button installed at a top of the insulating seat; the sliding member or button protruding from an aperture at a top of the insulating casing; a lower side of the sliding member or button having supporting pins; a terminal seat installed in the insulating seat; and the terminal seat having two push portions; a female terminal installed on the terminal seat; the female terminal having two positioning portions; each positioning portion having a projection; when male terminals are inserted into the female terminal, the sliding member or button being pushed so that the supporting pins of the sliding member or button move forwards to push the positioning portions; and then the projections will be buckled into round holes of the male terminals and thus the male terminal being fixed.

2 Claims, 7 Drawing Sheets

FIRM-STRUCTURED PLUG

FIELD OF THE INVENTION

The present invention relates to plugs, and particularly to a firmly secured plug, wherein male terminals are firmly secured without affecting the electric contact of the terminal. A sliding member or button of the plug is made of plastic and thus it will not rub and wear the metal terminals of the plug.

BACKGROUND OF THE INVENTION

Referring to FIG. 1, a prior art terminal is illustrated. The prior art terminal has a receptacle. When a plug is inserted into the receptacle, no structure is used to fix the plug. For a long time, it is very possible that the connection between the plug and receptacle will become loose and the power will interrupt so as to affect the operation of the electric device. If electric surge generates, it is possible that important data will lose so as to induce a great lose to users.

Thus the prior art plug is necessary to be improved.

SUMMARY OF THE INVENTION

Accordingly, the primary object of the present invention is to provide a plug, wherein male terminals are firmly secured without affecting the electric contact of the terminal. The sliding member or button is made of plastic and thus it will not rub and wear the metal terminals.

To achieve above object, the present invention provides a plug which comprises an insulating casing; an insulating seat installed in the insulating casing; a sliding member or button installed at a top of the insulating seat; the sliding member or button protruding from a hole at a top of the insulating casing; a lower side of the sliding member or button having supporting pins; a terminal seat installed in the insulating seat; and the terminal seat having two push portions; a female terminal installed on the terminal seat; the female terminal having two positioning portions; each positioning portion having a projection; when male terminals are inserted into the female terminal; the sliding member or button being pushed so that the supporting pins of the sliding member or button move forwards to push the positioning portions of the terminal seat; and then the projections of the positioning portions will be buckled into round holes of the male terminals and thus the male terminal being fixed; thereby, the male terminal being firmly secured.

The various objects and advantages of the present invention will be more readily understood from the following detailed description when read in conjunction with the appended drawing.

BRIEF DESCRIPTION OF THE DRAWINGS

FIGS. 3-1 is an exploded view of the plug of the present invention.

FIGS. 3-2 is a lateral view showing a part of the female terminal of the present invention.

FIGS. 3-3 is a perspective view showing the rear view of the insulating seat of the present invention.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features and characteristics of the present invention, but not to be used to confine the scope and spirit of the present invention defined in the appended claims.

Figure 1:
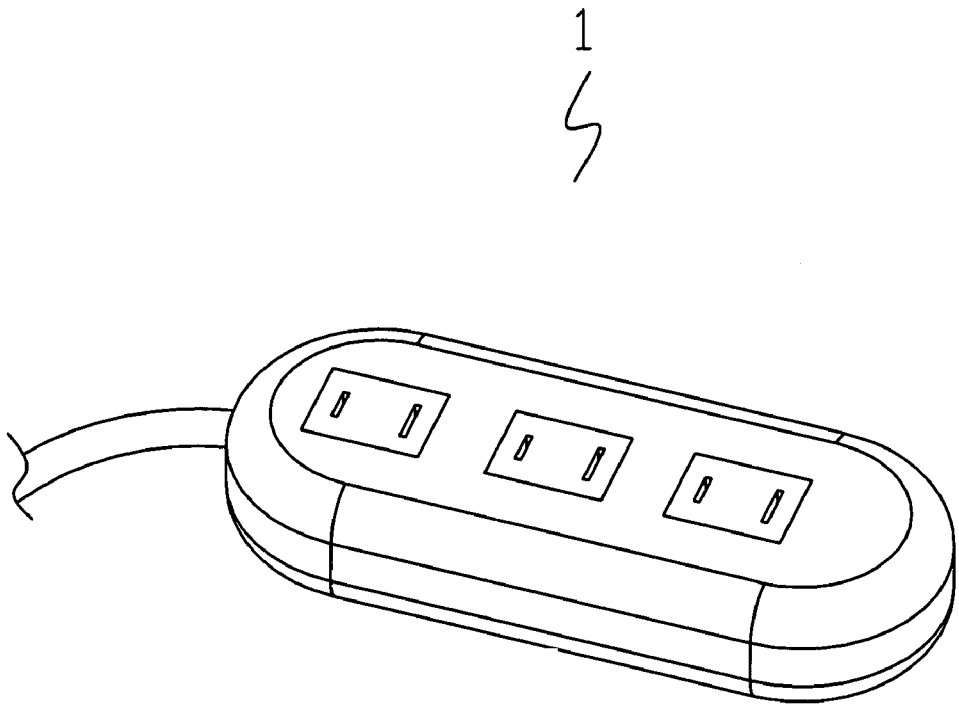
FIG.1(PRIOR ART)
FIG. 1 shows a prior art plug.
Figure 2:
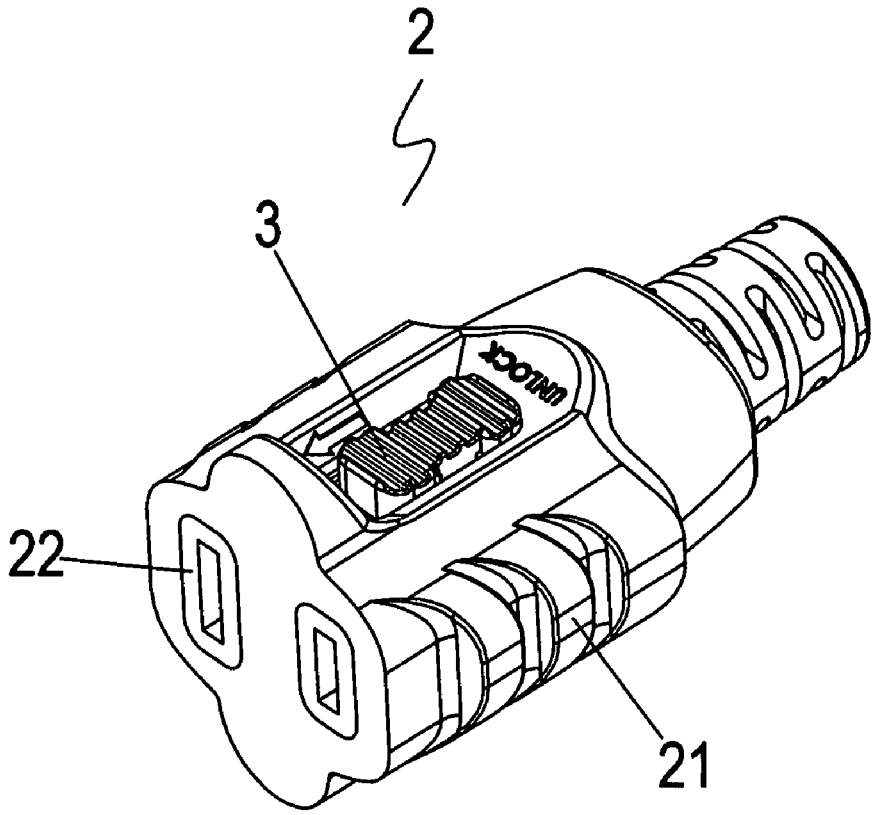
FIG. 2 shows the plug of the present invention.
Figures 1, 3:
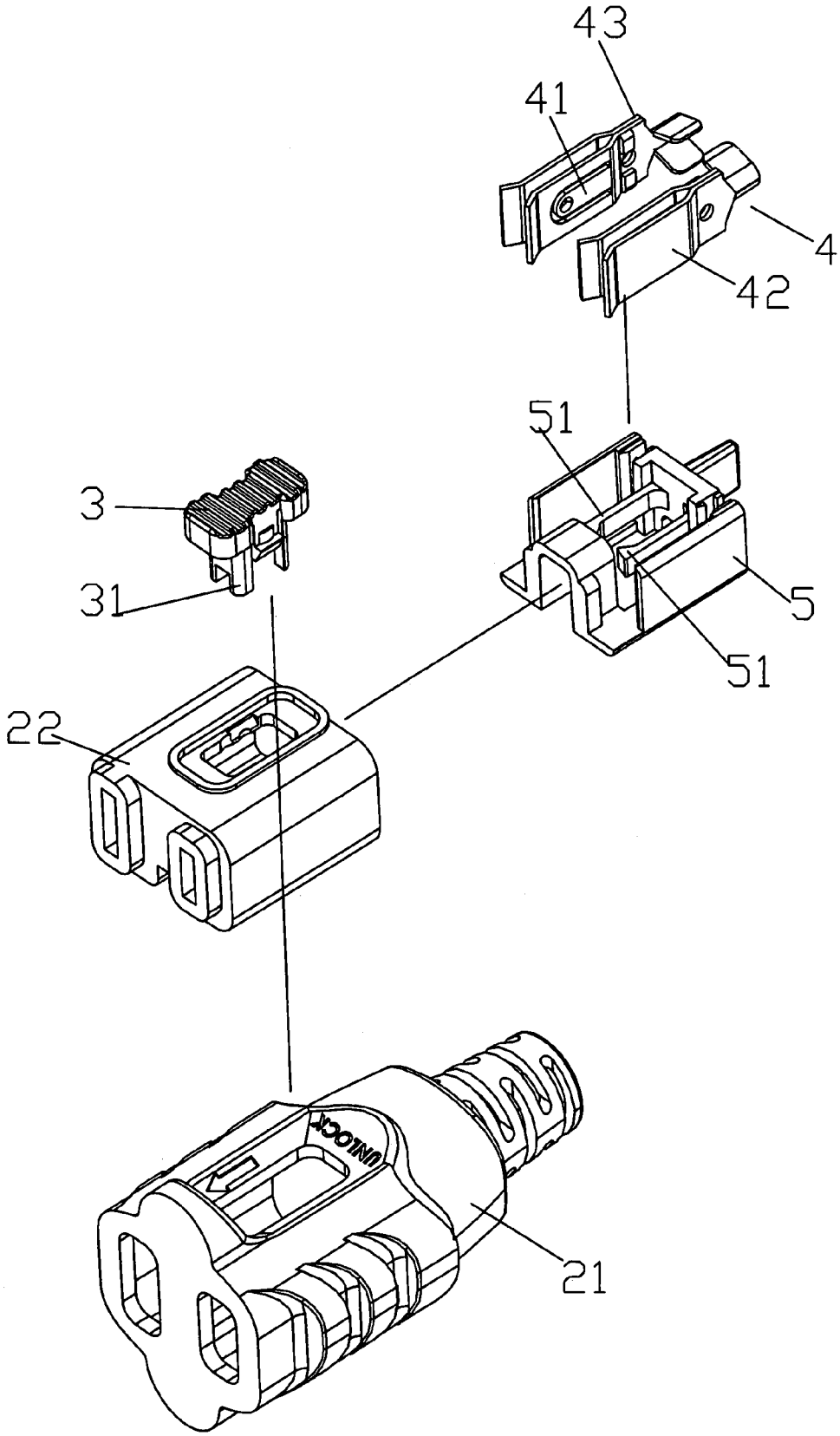
Figures 2, 3:
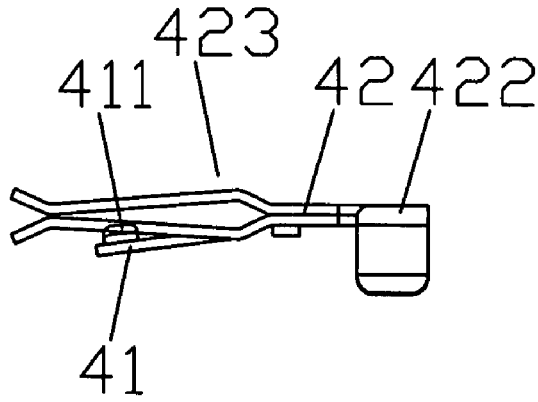
Figure 3:
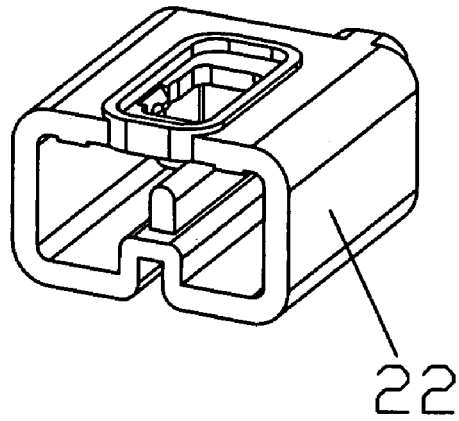

Referring to FIGS. 2, 3-1, 3-2, and 3-3, the plug structure of the present invention is illustrated. The plug 2 of the present invention has the following elements.

An insulating casing 21 is included.

An insulating seat 22 is installed in the insulating casing 21.

A sliding member or button 3 is installed at a top of the insulating seat 22. The sliding member or button 3 protrudes from an aperture at a top of the insulating casing 21. A lower side of the sliding member or button 3 has supporting pins 31.

A terminal seat 5 is installed in the insulating seat 22. The terminal seat 5 has two push portions 51.

A female terminal 4 is installed on the terminal seat 5. One end of the female terminal 4 has two arms which extend out of the terminal seat 5 and then are fixed to the insulating seat 22. Another end of the female terminal 4 is formed as two clamping portions. Each clamping portion is formed by two conductive sheets and has an opening for receiving the male terminal 6. Each inner sheet of the clamping portion is embedded with a positioning portion 41. The positioning portion 41 is an elastic metal sheet extending from the conductive sheet of the clamping portion. A front end of the positioning portion 41 is installed with a projection 411 which can buckle the male terminal 6 for fixing the male terminal 6. Further, referring to FIG. 3, the female terminal 4 includes a first sub-terminal 42 and a second sub-terminal 43. The first sub-terminal 42 has an arm 422 and two conductive sheets 423. The two conductive sheets of the first sub-terminal 42 are formed as a clamping portion. One conductive sheet nearer the second sub-terminal is extended with a positioning portion 41. A projection 411 is protruded from the positioning portion 41 and is between the positioning portion 41 of the first sub-terminal 42 and the conductive sheet 423 of the first sub-terminal 42. The second sub-terminal 43 has a structure identical to that of the first sub-terminal 42, but arranged oppositely to that of the first sub-terminal 41.

Figure 4:
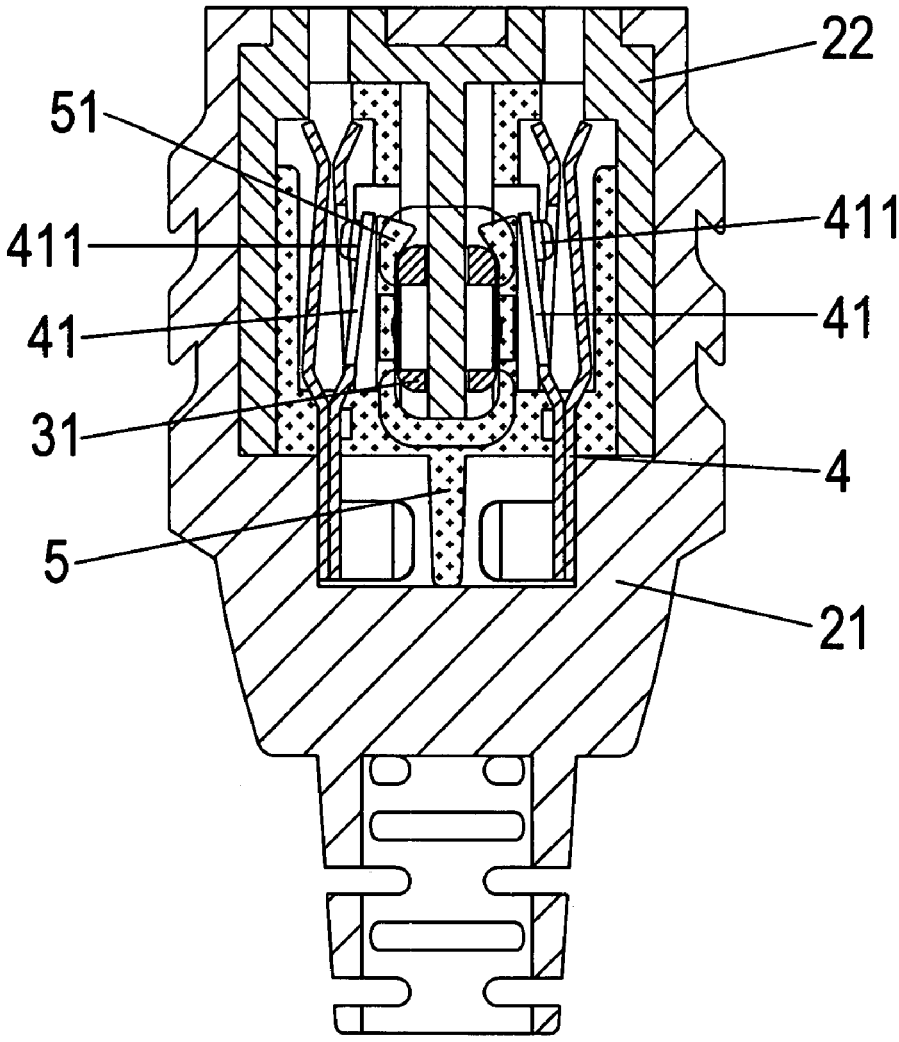
FIG. 4 is a cross sectional view of the plug of the present invention.
Figure 5:
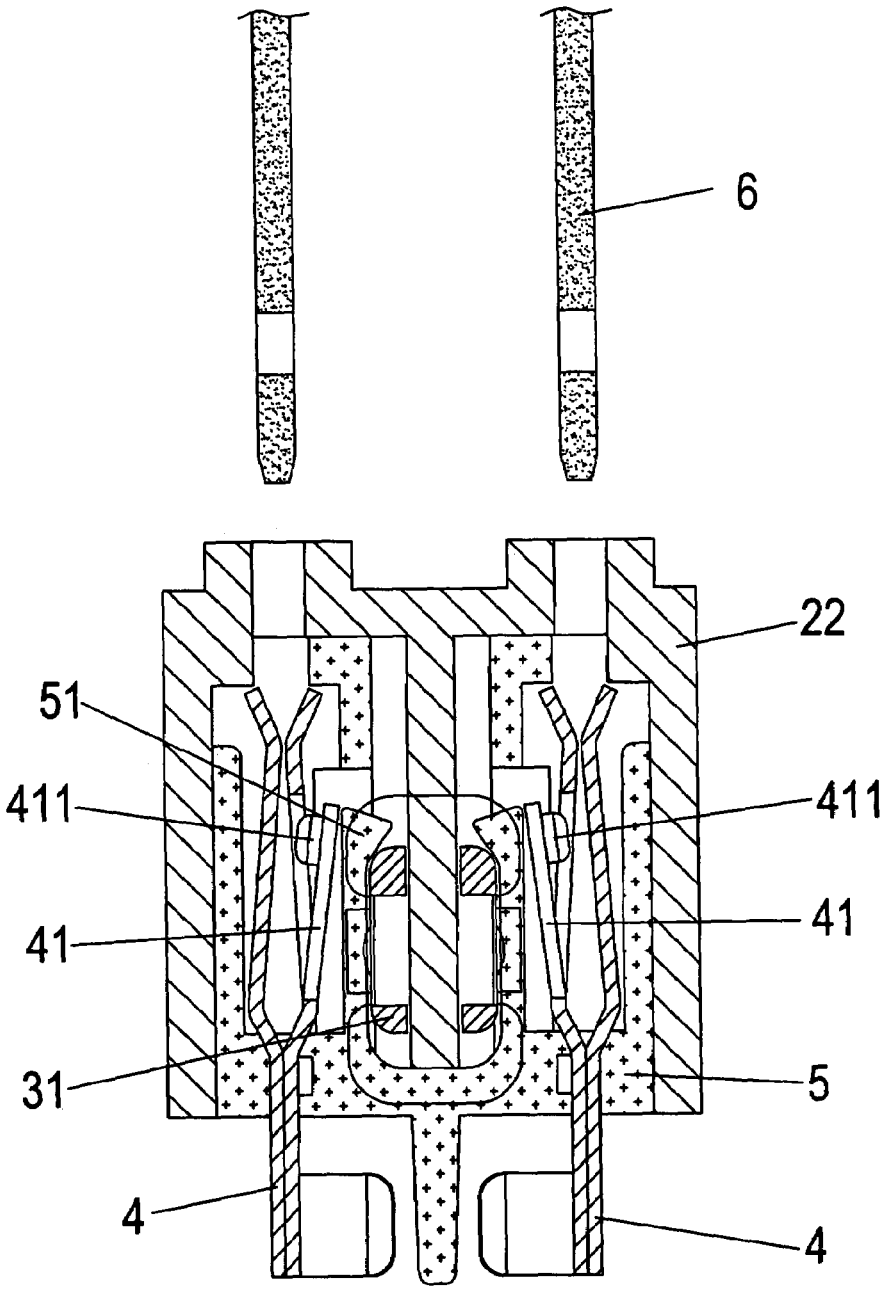
FIG. 5 is a schematic view about the plug of the present invention.
Figure 6:
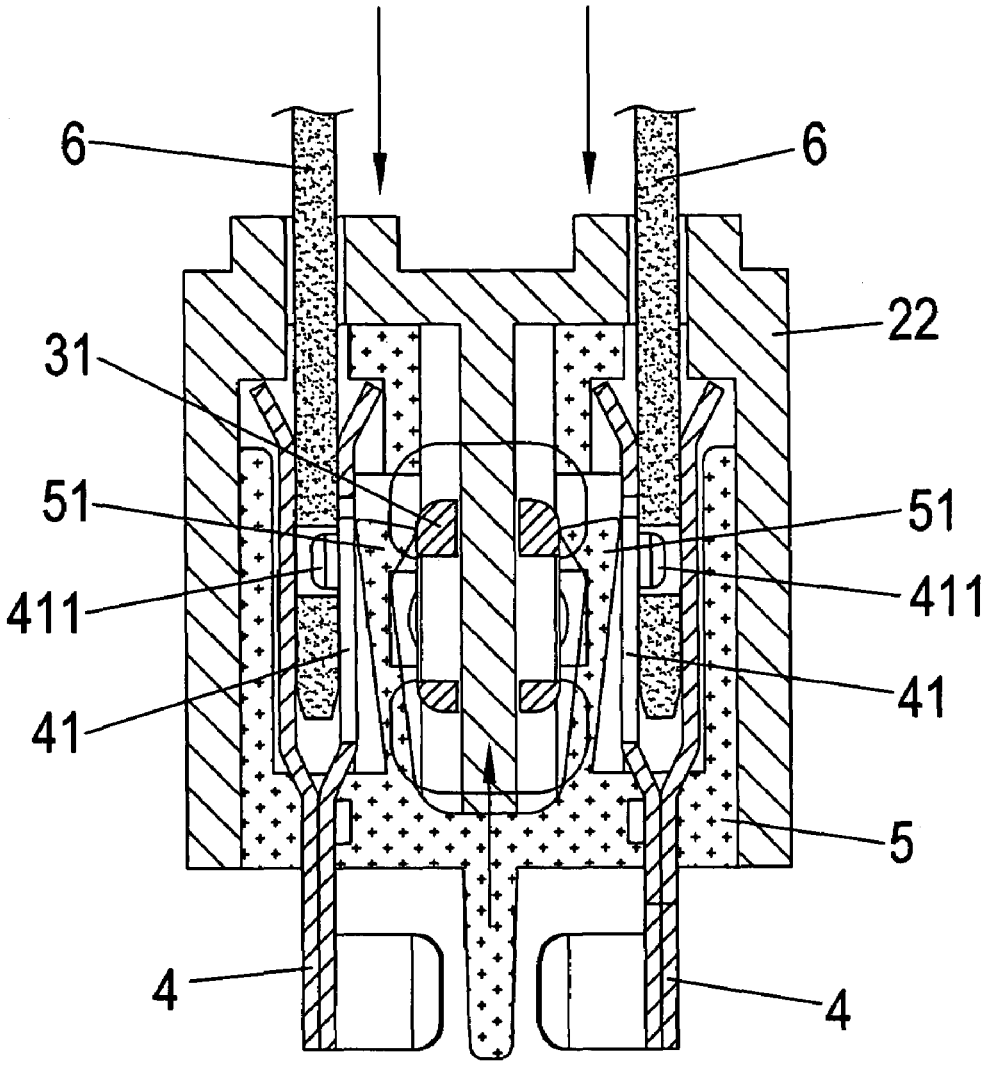
FIG. 6 is another schematic view about the plug of the present invention.

With reference to FIGS. 4, 5 and 6, it is illustrated that the insulating casing 21 encloses the insulating seat 22. An inner side of the insulating seat 22 is installed with the terminal seat 5. The terminal seat 5 has two push portions 51. The supporting pins 31 of the sliding member or button 3 resist against the push portions 51. The female terminal 4 inserts into the terminal seat 5. The female terminal 4 is installed with the positioning portion 41. The positioning portion 41 has a projection 411 for fixing a male terminal 6. When the male terminals 6 inserts into the clamping portions of the female terminal 4, the push portions 51 will further push the positioning portions 41 of the male terminal 6 to move toward two sides. Then the projections 411 of the positioning portions 41 will buckle into round holes of the male terminals 6. Thus the male terminals 6 are buckled to the female terminal 4 tightly.

Advantages of the present invention will be described herein. The male terminals 6 are firmly secured without affecting the electric contact of the terminal. The sliding member or button is made of plastic and thus it will not rub and wear the metal terminals.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A plug comprising:

an insulating casing;

an insulating seat installed in the insulating casing; the insulating seat having a cubic shape with one opened side; a side opposite to the opened side of the insulating seat having two slots; and a top side of the insulating seat having a recess which is communicated to a hollow central space of the insulating seat;

a sliding member or button installed in the recess at the top side of the insulating seat; the sliding member or button protruding from an aperture of the insulating casing; a lower side of the sliding member or button having four supporting pins and an upper surface of the sliding member or button being formed as a teeth surface;

a terminal seat installed in the insulating seat; and the terminal seat having two push portions;

a female terminal installed on the terminal seat; the female terminal having a first sub-terminal and a second sub-terminal, the first sub-terminal having an arm and two conductive sheets; the two conductive sheets of the first sub-terminal being formed as a clamping portion; one conductive sheet nearer the second sub-terminal being extended with a positioning portion; and a projection being protruded from the positioning portion and being between the positioning portion of the first sub-terminal and the conductive sheet of the first sub-terminal; the second sub-terminal having a structure identical to that of the first sub-terminal, but arranged oppositely to that of the first sub-terminal;

wherein when male terminals are inserted into the female terminal; the sliding member or button being pushed so that the supporting pins of the sliding member or button move forwards to push the positioning portions of the terminal seat; and then the projections of the positioning portions will be buckled into round holes of the male terminals and thus the male terminal being fixed; thereby, the male terminal being firmly secured;

wherein the positioning portion is an elastic metal sheet; and wherein the positioning portion is installed in a hole of the conductive sheet of the clamping portion near a center of the terminal seat.

2. The plug as claimed in claim 1, wherein a front end of the positioning portion formed with the projection can buckle the male terminal for fixing the male terminal.

* * * * *